US006417606B1

(12) United States Patent
Nakamoto et al.

(10) Patent No.: US 6,417,606 B1
(45) Date of Patent: Jul. 9, 2002

(54) FIELD EMISSION COLD-CATHODE DEVICE

(75) Inventors: Masayuki Nakamoto, Chigasaki; Katsuyoshi Fukuda, Yokosuka, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/414,840

(22) Filed: Oct. 8, 1999

(30) Foreign Application Priority Data

Oct. 12, 1998 (JP) ..... 10-289538

(51) Int. Cl.[7] ..... H01J 1/30

(52) U.S. Cl. ..... 313/336; 313/309; 313/311; 313/351; 313/346 R

(58) Field of Search ..... 313/308, 309, 313/336, 351, 495, 497, 346 R

(56) References Cited

U.S. PATENT DOCUMENTS 5,483,118 A 1/1996 Nakamoto et al.
5,727,976 A 3/1998 Nakamoto et al.
5,744,195 A * 4/1998 Jin et al. ..... 313/311 X
5,747,926 A 5/1998 Nakamoto et al.
5,749,762 A 5/1998 Nakamoto et al.
5,760,536 A * 6/1998 Susukuda et al. ..... 313/311
5,786,656 A 7/1998 Hasegawa et al.
5,793,154 A * 8/1998 Itoh et al. ..... 313/495 X
5,834,324 A 11/1998 Nakamoto
5,847,496 A 12/1998 Nakamoto et al.
5,888,113 A * 3/1999 Anderson et al. ..... 313/311 X
5,962,958 A 10/1999 Nakamoto
6,091,190 A * 7/2000 Chalamala et al. ..... 313/336 X

FOREIGN PATENT DOCUMENTS

JP 6-89652 3/1994
JP 7-147128 6/1995

* cited by examiner

*Primary Examiner*—Ashok Patel
(74) *Attorney, Agent, or Firm*—Oblon, Spivak, McClelland, Maier & Neustadt, P.C.

(57) ABSTRACT

In a field emission cold-cathode device, a cathode line or electrode is arranged on a glass substrate. An emitter is arranged on the cathode electrode and is formed of a conductive layer, a low-work-function material layer, and a tip layer stacked one on top of the other in this order. The emitter has a pyramid shape in which the tip layer has a sharp tip. The low-work-function material layer is made of a material having a work function of 4.0 eV or less. The tip layer is made of a material having a negative electron affinity and formed of granular bodies or linear bodies each having a diameter of 100 nm or less.

20 Claims, 11 Drawing Sheets

FIELD EMISSION COLD-CATHODE DEVICE

BACKGROUND OF THE INVENTION

The present invention relates to a cold-cathode device for field-emitting electrons, and a vacuum micro device, such as an image display device, employing the cold-cathode device.

Recently, field emission cold-cathode devices using semiconductor processing technologies are being actively developed. As one representative example, a device described by C. A. Spindt et al. in Journal of Applied Physics, Vol. 47, 5248 (1976) is known. This field emission cold-cathode device is manufactured by forming an $SiO_2$ layer and a gate electrode layer on an Si single-crystal substrate, forming therein a hole having a diameter of about 1.5 $\mu$m, and forming a conical emitter for performing field emission in this hole by vapor deposition while rotating the Si single-crystal substrate.

However, the above manufacturing method and the field emission cold-cathode device manufactured by the method have the following problems.

First, a rotational deposition method is performed such that the diameter of the pinhole formed in the gate electrode gradually decreases, thereby forming the shape of the emitter in the hole. For this reason, the height of the emitter and the shape of the tip of the emitter vary, and this degrades the uniformity of field emission. Additionally, the reproducibility of the shape and the yield are low. This greatly increases the production cost in manufacturing a large number of field emission cold-cathode devices having uniform characteristics on a single substrate.

Further, since the tip of the emitter necessary to improve the field emission efficiency lacks sharpness, the driving voltage is increased. This poses problems such as a reduction in the field emission efficiency and an increase in the consumption power. When a high driving voltage is used, the shape of the emitter tip readily changes under the influence of a residual gas ionized by this voltage. This also raises problems in terms of reliability and service life.

Furthermore, where a high driving voltage is used, an arc discharge, which degrades and/or destroys emitters, is caused, thereby making the electron device lose its function. For this reason, the electron device is generally set at a vacuum pressure of $10^{-5}$ Torr or less, and preferably $10^{-6}$ Torr or less, at which arc discharges are prevented from being caused, nevertheless an arc discharge still occasionally occurs.

BRIEF SUMMARY OF THE INVENTION

The present invention has been made to solve the above problems, and one of its objects is to provide a field emission cold-cathode device having uniform field emission characteristics, capable of being driven with a low voltage, and also having a high field emission efficiency, and a vacuum micro device, such as an image display device, employing the cold-cathode device.

According to a first aspect of the present invention, there is provided a field emission cold-cathode device comprising:

a support member; and an emitter formed on the support member to emit electrons, the emitter comprising at a surface an electron-emission layer including a first part consisting essentially of a first conductive material having a work function of 4.0 eV or less, and a second part arranged in contact with the first part and consisting essentially of a second conductive material having a negative electron affinity, one of the first and second parts comprising granular bodies or linear bodies each having a diameter of 100 nm or less.

According to a second aspect of the present invention, there is provided a vacuum micro device comprising:

a support member;

an emitter formed on the support member to emit electrons, the emitter comprising at a surface an electron-emission layer including a first part consisting essentially of a first conductive material having a work function of 4.0 eV or less, and a second part arranged in contact with the first part and consisting essentially of a second conductive material having a negative electron affinity, one of the first and second parts comprising granular bodies or linear bodies each having a diameter of 100 nm or less;

a surrounding member for forming, together with the support member, a vacuum discharge space surrounding the emitter; and an extracting electrode arranged to be spaced apart from the emitter, the emitter emitting electrons due to a potential difference between the emitter and the extracting electrode.

According to a third aspect of the present invention, there is provided an image display device comprising:

a support member;

an emitter formed on the support member to emit electrons, the emitter comprising at a surface an electron-emission layer including a first part consisting essentially of a first conductive material having a work function of 4.0 eV or less, and a second part arranged in contact with the first part and consisting essentially of a second conductive material having a negative electron affinity, one of the first and second parts comprising granular bodies or linear bodies each having a diameter of 100 nm or less;

a surrounding member for forming, together with the support member, a vacuum discharge space surrounding the emitter;

an extracting electrode arranged to be spaced apart from the emitter, the emitter emitting electrons due to a potential difference between the emitter and the extracting electrode; and a display portion for displaying an image in accordance with excitation by electrons emitted from the emitter, the display portion being turned on and off under a control of the potential difference between the emitter and the extracting electrode, on which emission of electrons from the emitter depends.

In the present invention, an emitter has an electron-emission layer including a first part consisting essentially of a first conductive material having a work function of 4.0 eV or less (low-work-function material), and a second part arranged in contact with the first part and consisting essentially of a second conductive material having a negative electron affinity (NEA material). At least one of the first and second parts comprises granular bodies or linear bodies each having a diameter of 100 nm or less, and preferably 30 nm or less, but not less than 1 nm.

The tip of each linear body is also set to have a radius of curvature of 50 nm or less, and preferably 15 nm or less. With the combination of these features in materials and shapes, electrons are easily emitted from the emitters by field emission, so that the device can be driven with a low voltage, and have field emission characteristics improved to be uniform and stable.

Especially, where the second part of a NEA material positioned on the upper side, electrons are supplied from the cathode electrode through the first part of a low-work-function material, and emitted from the second part of a NEA material. In this case, the driving voltage is further reduced while improving stability and uniformity of the emitted current, because the Schottky barrier height in the electron-emission layer is lowered, and NEA materials present excellent field emission characteristics.

Further, since at least one of the first and second parts comprises granular bodies or linear bodies, the emitter need not to be entirely formed of granular bodies or linear bodies. If the entirety of the emitter were to be formed of granular bodies or linear bodies, these bodies would be hardly stably adhered to each other. Where only the surface portion of the emitter is formed of granular bodies or linear bodies, these bodies can be adhered to each other more easily.

In a flat-type emitter, the conductive support layer also works as an adhesion layer for fixing the granular bodies or linear bodies in the electron-emission layer, and thus the bodies can be easily fixed. Further, the conductive support layer allows a voltage to be uniformly applied, thereby preventing an abnormal discharge.

Where a ballast resistor layer made of a resistive material is included in the conductive support layer, the device is provided with a current restriction effect, which can reduce the degree of damage, degradation, and current fluctuation due to overcurrent or current fluctuation, so that a more stable emitted current is obtained.

The above described advantages in a flat-type emitter are further enhanced by a convex emitter preferably with a gate electrode. In this case, it is possible to fix an electron emission point and to control the device more easily so as to further improve uniformity and stability of the emitted current, thereby preferably applying the device to a flat-type image display device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

[First Embodiment]

Figure 1:
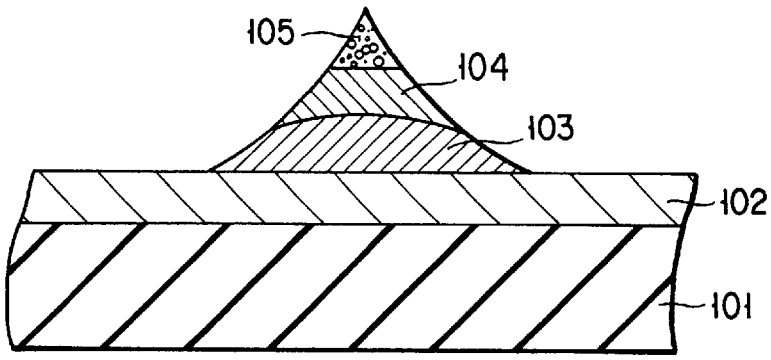
FIG. 1 is a cross-sectional view showing a field emission cold-cathode device according to a first embodiment of the present invention.

FIG. 1 is a cross-sectional view showing a field emission cold-cathode device according to a first embodiment of the present invention.

A cathode line or electrode 102 is arranged on a glass substrate 101. On the cathode electrode 102, there is an emitter formed of a conductive layer 103, a low-work-function material layer 104, and a tip layer 105 stacked one on top of the other in this order. The emitter has a pyramid shape with the tip layer 105 having a sharp tip. The conductive layer 103 and the low-work-function material layer 104 constitute a conductive support layer.

The tip layer 105 is formed of a number of granular bodies or linear bodies, such as fillers or whiskers, sticking to each other, and made of a material having a negative electron affinity (NEA), such as AlN, GaN, or diamond. The tip layer 105 may be formed of the granular bodies and linear bodies mixed with each other. The low-work-function material layer 104 is made of a material having a work function not greater than that of ordinary metals, i.e., 4.0 eV.

The granular bodies or linear bodies each have a very small diameter of 100 nm or less, and preferably 30 nm or less, but not less than 1 nm. The tip of each linear body is also set to have a radius of curvature of 50 nm or less, and preferably 15 nm or less.

FIGS. 2A to 2E are cross-sectional views showing steps of a method of manufacturing the field emission cold-cathode device shown in FIG. 1.

First, a mold substrate is prepared such that recesses with pointed bottoms are formed in one surface of the substrate. The mold substrate having such recesses may be formed of Si, Ni, Fe, Fe—Ni alloy, porous Si, porous Al, porous Ta, a resin, a ultraviolet-setting resin, a thermosetting resin, an organic substance, a metal film, or an organic film. Using the mold substrate several times, an emitter-forming process, as describe later, can be repeatedly applied to a plurality of substrates.

In this embodiment, the mold substrate is formed of a single-crystal silicon substrate. First, a 0.1-$\mu$m thick $SiO_2$ thermal oxide layer is formed by a dry oxidation method on the p-type (100)-oriented Si single-crystal substrate 201 serving as the mold substrate. Subsequently, the surface of the thermal oxide layer is coated with a photoresist by spin coating to form a photoresist layer.

Subsequently, a stepper is used to perform processing steps such as exposure and development so as to obtain a plurality of openings, e.g., square openings of sides of 1 $\mu$m arranged in a matrix format, thereby patterning the photoresist layer. The photoresist layer is then used as a mask to etch the $SiO_2$ film by an $NH_4F$—HF solution mixture.

Figure 2A:
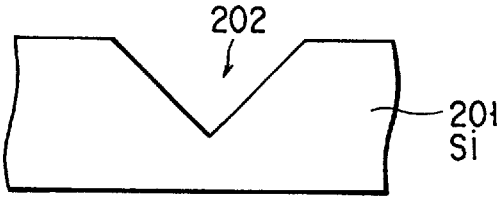
FIGS. 2A to 2E are cross-sectional views showing steps of a method of manufacturing the field emission cold-cathode device shown in FIG. 1.

After the photoresist layer is removed, anisotropic etching is performed by an aqueous 30-wt % KOH solution, thereby forming recesses 202 having a depth of 0.71 $\mu$m in the Si single-crystal substrate 201. Subsequently, the $SiO_2$ oxide layer on the Si single-crystal substrate 201 is removed by using an $NH_4F$—HF solution mixture. Each recess 202 is formed into an inverse pyramid defined by four inclined surfaces that are (111) planes by being etched with the aqueous KOH solution (FIG. 2A).

Figure 2B:
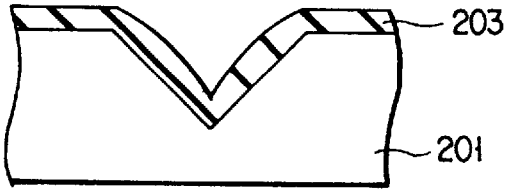

Then, an $SiO_2$ thermal oxide insulating layer 203 is formed on a region of the Si single-crystal substrate 201 including the recess 202. In this embodiment, the $SiO_2$ thermal oxide insulating layer 203 is formed to have a thickness of 0.3 $\mu$m by a wet oxidation method (FIG. 2B).

Subsequently, a tip layer 105, which is formed of a number of granular bodies or linear bodies consisting of a material having a negative electron affinity (NEA), such as AlN, GaN, or diamond, is formed on the $SiO_2$ thermal oxide insulating layer 203 at the bottom of the recess 202. The tip layer 105 may be applied by means of vapor deposition, sputtering, CVD, printing, dispensing, painting, dipping, a method using an ultrasonic wave, a method using vibration, or the like.

Figure 2C:
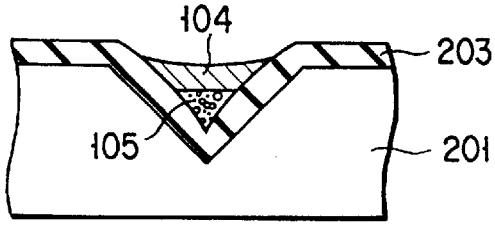

Then, a low-work-function material layer 104, which consists of a material having a work function of 4.0 eV or less, such as $LaB_6$, TiN, TiC, carbon nanotube, or cermet, is formed on the tip layer 105 in the recess 202, by a method similar to that for the tip layer 105 (FIG. 2C). The low-work-function material layer 104 is used to lower the surface barrier height between the tip layer 105 consisting of a NEA material, such as diamond, and the conductive support layer, so that a number of electrons are stably supplied to the tip of the emitter.

Then, a conductive layer 103 made of, e.g., Ta, W, Mo, Cr, Cu, or Si is selectively formed on the low-work-function material layer 104 to fill the recess. Then, a cathode electrode 102 is formed on the conductive layer 103 and the insulating layer 203, for the cathode electrode 102 to also work as a joint layer for coupling the conductive layer 103 with the support substrate, i.e., the glass substrate. The conductive layer 103 may be formed all over, and then be patterned to form a line on the $SiO_2$ thermal oxide insulating layer 203, thereby causing the conductive layer 103 to work also as a cathode electrode.

Figure 2D:
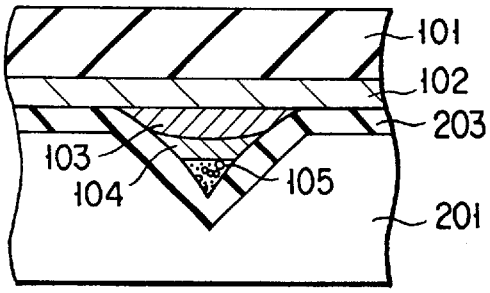

On the other hand, a support substrate, i.e., a glass substrate 101, is prepared, and is adhered to the single-crystal substrate 201, with the cathode electrode 102, the conductive layer 103, and the low-work-function material layer 104 interposed therebetween (FIG. 2D). In this embodiment, the backside of the glass substrate is coated with an Al layer, and electrostatic adhesion is used to perform this adhesion, though an adhesive may be used instead. Then, the Al layer on the backside of the glass substrate 101 is removed by a mixed acid solution of, e.g., $HNO_3$—HF. The cathode electrode 102 may be formed on the glass substrate 101 in advance, instead of being formed on the single-crystal substrate 201.

Figure 2E:
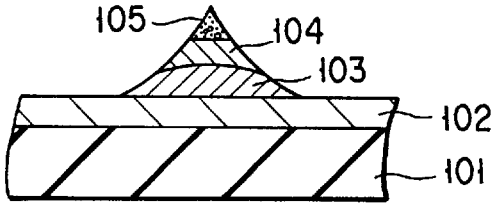

Subsequently, the single-crystal substrate 201 is removed by means of dissolution, pealing, or the like, so that the emitter formed of the conductive layer 103, the low-work-function material layer 104, and the tip layer 105, having being shaped in the recess of the single-crystal substrate 201, is exposed on the glass substrate 101 (FIG. 2E). By using these steps, a field emission cold-cathode device, which has a sharp emitter and a high mass-productivity, is provided.

Although the tip layer 105 consists of a material having a negative electron affinity, the tip layer 105 may be formed of granular bodies or linear bodies consisting of another material. For example, the tip layer 105 may consists of a material having a work function of 4.0 eV or less, such as $LaB_6$, TiN, TiC, carbon nanotube, or cermet, or another conductive material, such as Mo, Ta, W, Ta, Ni, Cr, Au, Ag, Pd. Cu, Al, Sn, Pt, Ti, Fe, Si, beta W, SiC, $Al_2O_3$, carbon, graphite, fullerene, boric aluminum ($9Al_2O_3$-$2B_2O_3$), or potassium titanate. When any one of these materials is used, the surface barrier height between the material and the conductive support layer is not high, unlike the NEA materials, such as diamond. In this case, generally, a number of electrons are stably supplied to the tip layer, and thus the low-work-function material layer can be omitted.

The resultant structure thus obtained may be applied as it is to various kinds of electron devices. In order to draw more electrons from the tip layer, however, the resultant structure may be further provided with a gate electrode by fabrication steps shown in FIGS. 3A to 3D.

Figure 3A:
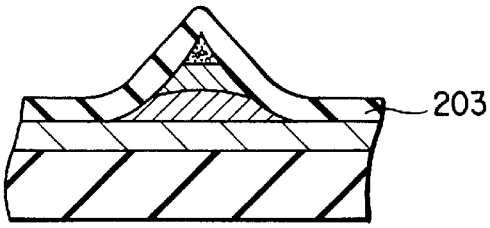
FIGS. 3A to 3D are cross-sectional views showing steps of a method of adding a gate electrode, following the step shown in FIG. 2E.
Figure 3B:
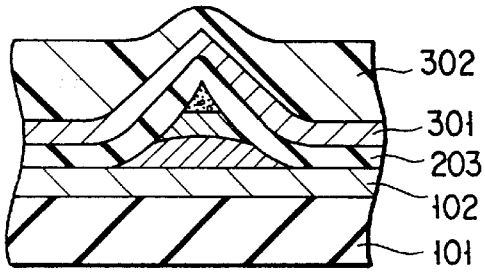

First, for example, in the state shown in FIG. 2D, only the single-crystal substrate 201 is removed, so that the $SiO_2$ thermal oxide insulating layer 203 is left as an insulating layer between the gate and emitter (FIG. 3A). Then, a conductive material layer 301 made of Ni, Cr, W, or the like is formed on the insulating layer 203 by means of electroless plating, electroplating, printing, sputtering, vapor deposition, or the like. Further, a photoresist layer 302 is formed on the conductive material layer 301 (FIG. 3B).

Figure 3C:
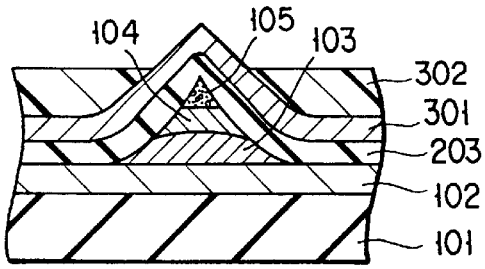

Subsequently, the photoresist layer 302 is etched back by means of, e.g., chemical dry etching, so that the part of the conductive material layer 301 at the pyramid tip is exposed (FIG. 3C). Thereafter, the part of the conductive material layer 301 at the pyramid tip is etched away by reactive ion etching to form an opening.

Figure 3D:
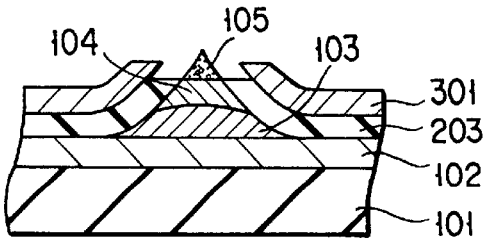

After the photoresist layer 302 is removed, the insulating layer 203 is selectively removed through the opening of the conductive material layer 301 by means of, e.g., wet etching. In this manner, the emitter is provided with a gate electrode 301 (FIG. 3D).

Where the insulating layer 203 is once removed, as shown in FIG. 2E, an insulating film made of $SiO_2$, SiN, or the like to be used as an insulating layer between the gate and emitter may be formed by means of CVD, sputtering, electron beam vapor deposition, printing, or the like.

Figure 4A:
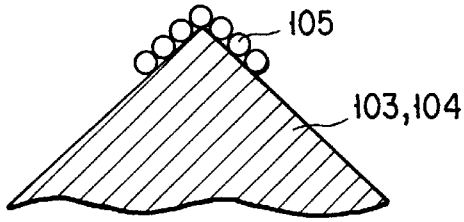
FIGS. 4A and 4B are cross-sectional views each showing a field emission cold-cathode device according to a modification of the first embodiment of the present invention.
Figure 4B:
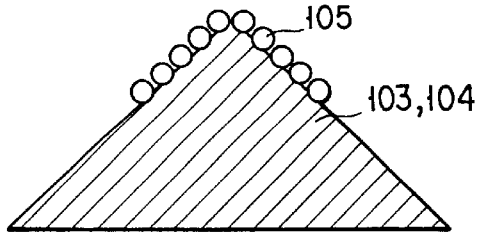

Although, in this embodiment, the tip layer 105 is arranged in the recess 202 in advance, the tip layer 105 may be arranged after the convex shape of the emitter is formed. Specifically, a conductive support layer having a convex shape is formed by molding a low-work-function material layer 104 and a conductive layer 103 in the recess 202. Then, a tip layer 105 formed of granular bodies or linear bodies is arranged on the surface of the convex shape of the conductive support layer, preferably on the surface at and around the tip by means of jet printing, dispensing, vapor-phase synthesis, vapor deposition, or the like (FIG. 4A). Using jet printing, a tip layer 105 formed of granular bodies or linear bodies may be arranged to be partly embedded in the surface of the convex shape of the conductive support layer (FIG. 4B).

According to this embodiment, since a tip layer formed of at least one of granular bodies and linear bodies is arranged on a conductive support layer formed of a conductive layer and a low-work-function material layer, field emission of electrons can be easily caused. Consequently, it is possible to provide a field emission cold-cathode device capable of being driven with a low voltage, and having field emission characteristics improved to be uniform and stable.

Further, since the tip layer is arranged on the conductive support layer, an emitter need not to be entirely formed of granular bodies or linear bodies. If the entirety of the emitter were to be formed of granular bodies or linear bodies, these bodies would be hardly stably adhered to each other. Where only the tip portion of the emitter is formed of granular bodies or linear bodies, these bodies can be adhered to each other more easily.

[Second Embodiment]

FIGS. 5A to 5F are cross-sectional views showing steps of a method of manufacturing a field emission cold-cathode device according to a second embodiment of the present invention.

Figure 5A:
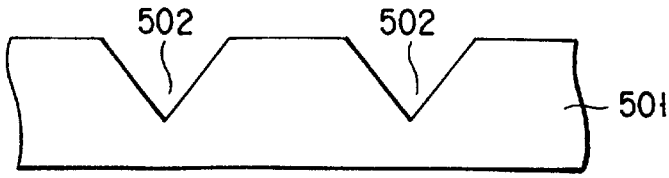
FIGS. 5A to 5F are cross-sectional views showing steps of a method of manufacturing a field emission cold-cathode device according to a second embodiment of the present invention.
Figure 5B:
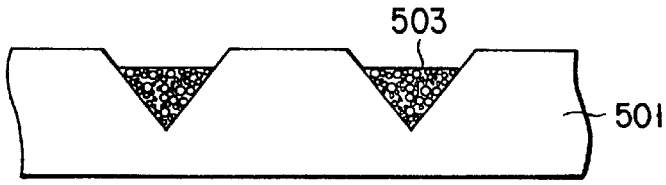

First, recesses 502 are formed in an organic film 501 used as a first substrate, by a method using laser, e.g., eximer laser (FIG. 5A). Then, an electron-emission layer 503 including granular bodies or linear bodies each preferably having a diameter of from 1 to 100 nm, is arranged in each recess 502 of the organic film by means of printing, vapor deposition, dipping, plating, or the like (FIG. 5B).

The electron-emission layer 503 may be formed of a low-work-function material having a work function of 4.0 eV or less, such as $LaB_6$, TiN, TiC, carbon nanotube, or cermet, and a NEA material having a negative electron affinity, such as AlN, GaN or diamond, in which one of the low-work-function material and the NEA material forms granular bodies or linear bodies having a very small diameter described before, and the other forms a covering layer filling the gaps among them.

The electron-emission layer 503 may be formed of a low-work-function material and a NEA material both forming granular bodies or linear bodies mixed with each other, and may further include another conductive material filling the gaps among them, if necessary.

The electron-emission layer 503 may be formed of granular bodies or linear bodies made only of another conductive material, such as Mo, Ta, W, Ta, Ni, Cr, Au, Ag, Pd, Cu, Al, Sn, Pt, Ti, Fe, Si, beta W, SiC, $Al_2O_3$, carbon, graphite, fullerene, boric aluminum ($9Al_2O_3$-$2B_2O_3$), or potassium titanate.

Figure 5C:
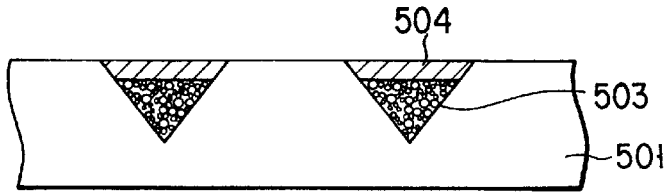

Subsequently, a conductive support layer 504 made of, e.g., Ta, W, Mo, Cr, Cu, or Si is arranged in the recess 502 (FIG. 5C). The conductive support layer 504 may be used as a cathode electrode.

Figure 5D:
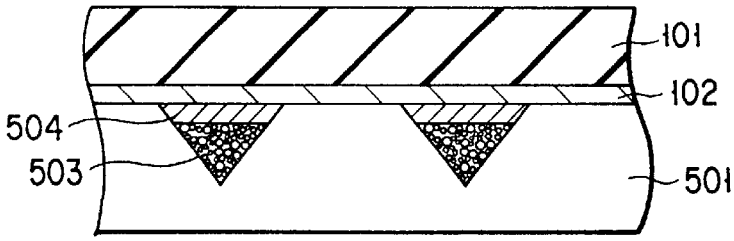
Figure 5E:
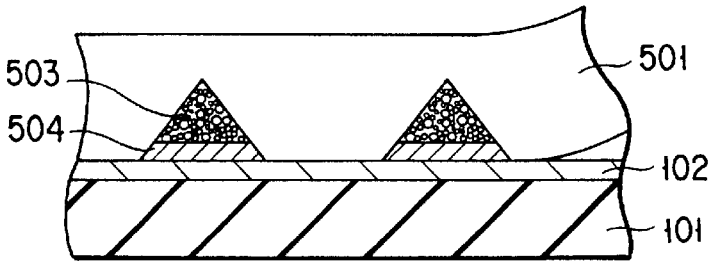

On the other hand, a support substrate, i.e., a glass substrate 101, with a cathode electrode 102 arranged on one of its sides, is prepared. The substrate 101 is adhered to the organic film 501 by a method using an adhesive, with the cathode electrode 102, the conductive support layer 504, and the electron-emission layer 503 interposed therebetween (FIG. 5D).

Figure 5F:
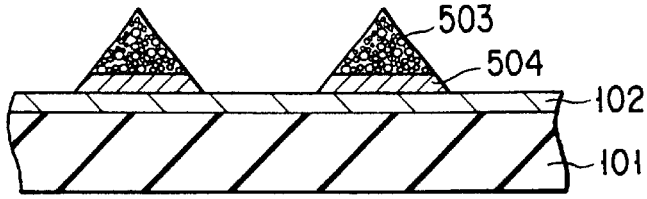

Subsequently, the organic film 501 is removed by means of dissolution, pealing or the like (FIG. 5E), so that the emitter formed of the electron-emission layer 503 and the conductive support layer 504, having been shaped in the recess 502 of the organic film 501, is exposed (FIG. 5F). By using these steps, a field emission cold-cathode device, which has a sharp emitter and a high mass-productivity, is provided.

The resultant structure thus obtained may be applied as it is to various kinds of electron devices. In order to draw more electrons from the tip layer, however, the resultant structure may be further provided with a gate electrode by fabrication steps shown in FIGS. 6A to 6D.

Figure 6A:
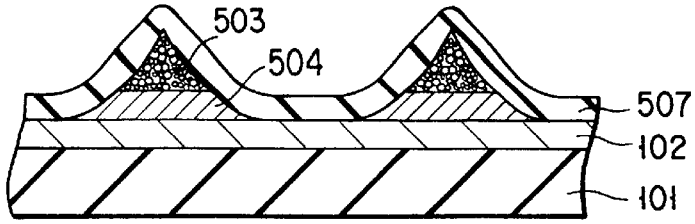
FIGS. 6A to 6D are cross-sectional views showing steps of a method of adding a gate electrode, following the step shown in FIG. 5F.
Figure 6B:
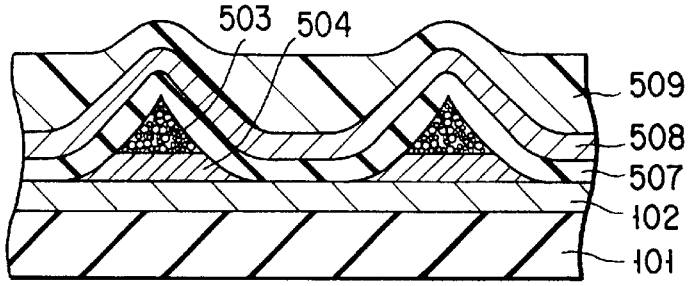

First, an insulating layer 507 made of $SiO_2$, SiN, or the like is formed as an insulating layer between the gate and emitter by means of CVD, sputtering, electron beam vapor deposition, printing, or the like (FIG. 6A). Then, a conductive material layer 508 made of Ni, Cr, W, or the like is formed on the insulating layer 507 by means of electroless plating, electroplating, printing, sputtering, vapor deposition, or the like. Further, a photoresist layer 509 is formed on the conductive material layer 508 (FIG. 6B).

Figure 6C:
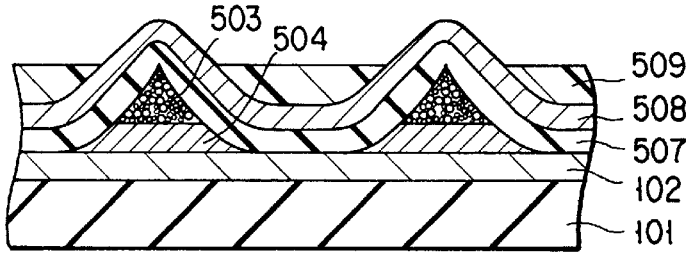

Subsequently, the photoresist layer 509 is etched back by means of, e.g., chemical dry etching, so that the part of the conductive material layer 508 at the tip of the convex shape is exposed (FIG. 6C). Thereafter, the part of the conductive material layer 508 at the pyramid tip is etched away by reactive ion etching to form an opening.

Figure 6D:
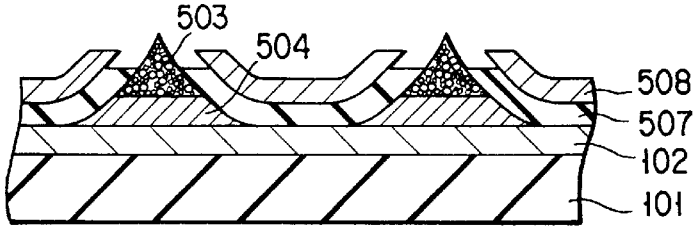

After the photoresist layer 509 is removed, the insulating layer 507 is selectively removed through the opening of the conductive material layer 508 by means of, e.g., wet etching. In this manner, the emitter is provided with a gate electrode 508 (FIG. 6D).

Note that the granular bodies or linear bodies may be applied to the surface of the convex shape of the emitter after the convex shape is formed, as in the first embodiment.

[Third Embodiment]

Figure 7:
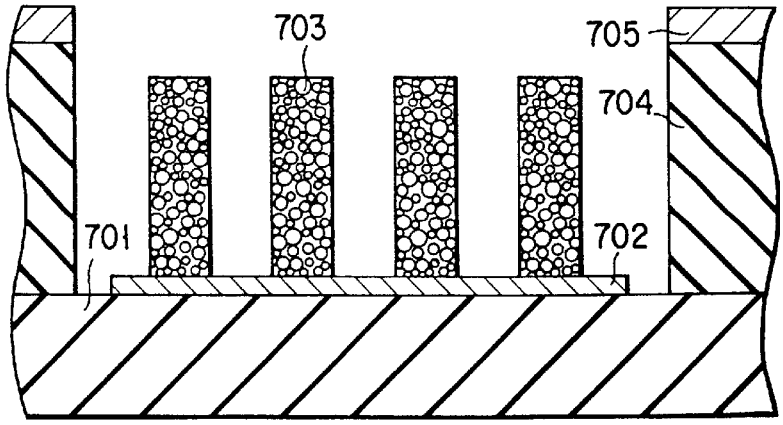
FIG. 7 is a cross-sectional view showing a field emission cold-cathode device according to a third embodiment of the present invention.

FIG. 7 is a cross-sectional view showing a field emission cold-cathode device according to a third embodiment of the present invention.

A cathode electrode 702 is arranged partly on a glass substrate 701. On the cathode electrode 702, several column-like emitters 703 are arranged. An insulating layer 704 is arranged on the glass substrate 701 to surround the cathode electrode 702. A gate electrode 705 is arranged on the insulating film 705.

The emitter 703 may be formed of a low-work-function material having a work function of 4.0 eV or less, and a NEA material having a negative electron affinity, in which one of the low-work-function material and the NEA material forms granular bodies or linear bodies having a very small diameter described before, and the other forms a covering layer filling the gaps among them. Further, the emitter 703 may be formed of a low-work-function material and a NEA material both forming granular bodies or linear bodies mixed with each other, and may further include another conductive material filling the gaps among them, if necessary. Furthermore, the emitter 703 may be formed of granular bodies or linear bodies made only of another conductive material, which is listed with reference to the electron-emission layer 503.

FIGS. 8A to 8F are cross-sectional views showing steps of a method of manufacturing the field emission cold-cathode device shown in FIG. 7.

Figure 8A:
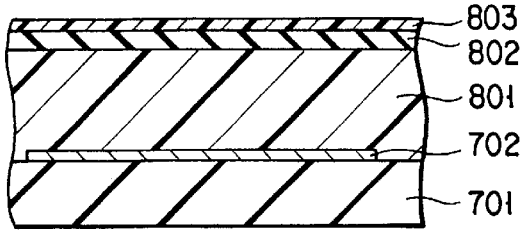
FIGS. 8A to 8F are cross-sectional views showing steps of a method of manufacturing the field emission cold-cathode device shown in FIG. 7.

First, a cathode electrode 702 is selectively formed on a predetermined region of a glass substrate 701. Then, an organic material layer 801 is formed on the cathode electrode 702 by means of painting or the like, and a $SiO_2$ insulating layer 802 and a photoresist layer 803 are sequentially stacked thereon (FIG. 8A). The insulating layer 802 may be omitted.

Figure 8B:
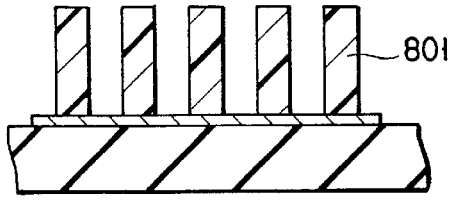
Figure 8C:
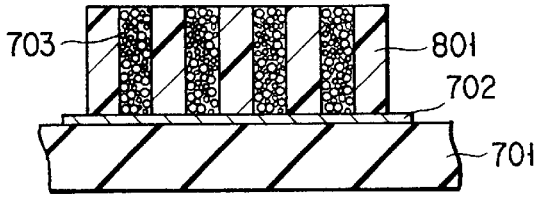

Subsequently, the photoresist layer 803 is patterned, and the insulating layer 802 is etched, using the photoresist layer 803 as a mask, to form an opening. The photoresist layer 803 is removed thereafter. Then, the organic material layer 801 on the cathode electrode 702 is etched by means of etching, using the insulating layer 802 as a mask, so that a recess or hole reaches the cathode electrode 702 and is surrounded by walls of the organic material layer 801. The insulating layer 802 is removed thereafter (FIG. 8B).

Subsequently, an emitter material consisting of granular bodies or linear bodies each preferably having a diameter of from 1 to 100 nm is introduced in the recess or between the walls to form emitters 703. The emitter may contain a conductive material mixed therein to support the granular bodies or linear bodies.

Figure 8D:
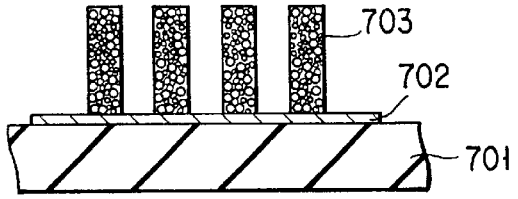
Figure 8E:
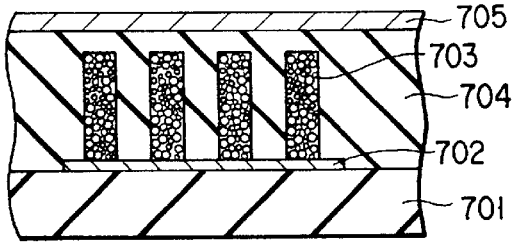
Figure 8F:
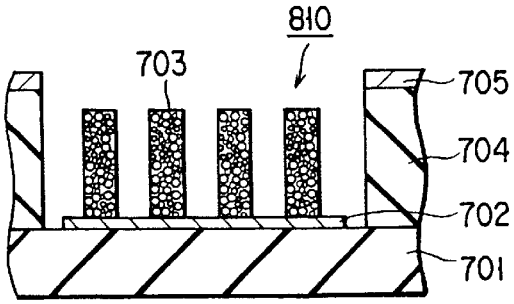

Subsequently, the organic material layer 801 is removed by means of dissolution, pealing, or the like (FIG. 8D). Then, an insulating layer 704 and a conductive material layer 705 are sequentially stacked all over (FIG. 8E). Then, the insulating layer 704 and the conductive material layer 705 are partly removed to form an opening 810 by a method using exposure, patterning, and etching. As a result, a plurality of column-like or convex emitters 703 are obtained in the opening with the electrode 705 around them.

[Fourth Embodiment]

Figure 9A:
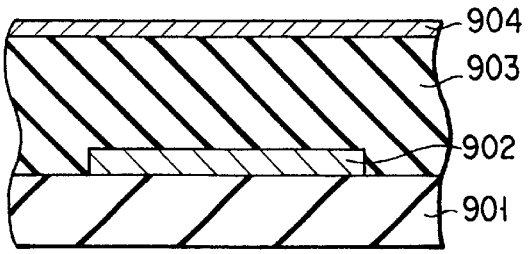
FIGS. 9A to 9C are cross-sectional views showing steps of a method of manufacturing a field emission cold-cathode device according to a fourth embodiment of the present invention.
Figure 9B:
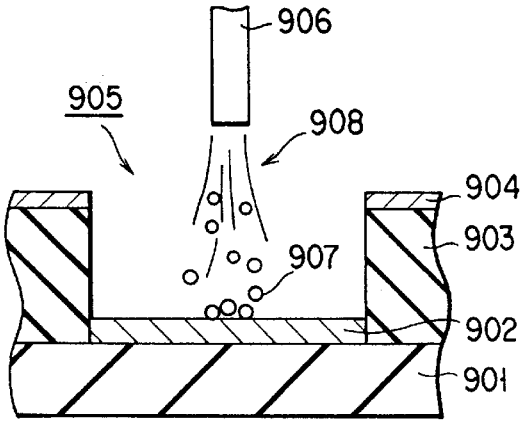
Figure 9C:
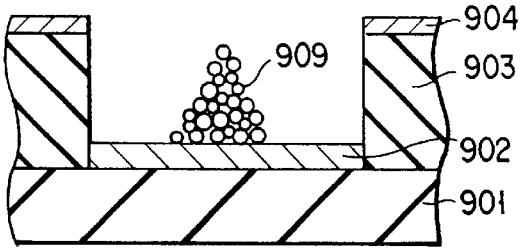

FIGS. 9A to 9C are cross-sectional views showing steps of a method of manufacturing a field emission cold-cathode device according to a fourth embodiment of the present invention.

First, a cathode electrode 902, an insulating layer 903, and conductive material layer (gate electrode) 904 are formed on a glass substrate 901 (FIG. 9A). The conductive material layer 904 and the insulating layer 903 are patterned to form an opening 905. Then, granular bodies 907 preferably having a diameter of 50 nm or less are sprayed as a high-speed flow from a nozzle 906 onto the cathode electrode 902 by means of jet printing or the like (FIG. 9B).

With this step, the granular bodies 907 stick to the cathode electrode 902, as well as sticking to each other, so that a convex emitter 909 consisting of granular bodies is formed (FIG. 9C). In this case, the granular bodies may be applied under atmospheric pressure or vacuum pressure for forming a stable flow.

The emitter 909 is preferably formed to have a structure in which a low-work-function material having a work function of 4.0 eV or less, and a NEA material having a negative electron affinity are combined. In this respect, the granular bodies 907 may be made of a low-work-function material and a thin covering layer made of a NEA material may be arranged to cover the granular bodies 907. The emitter 909 may be a mixture of granular bodies made of a low-work-function material and a NEA material. Further, the emitter 909 may be formed of granular bodies only of another conductive material, which is listed with reference to the electron-emission layer 503.

In this embodiment, granular bodies are sprayed on a substrate made of a glass, metal, ceramic, or resin, so that the granular bodies stick to the substrate and stick to each other to form an emitter. This technique is not limited to the formation of an emitter, but may be applied to formation of a cathode line, an insulating layer, or a gate line.

Figure 10A:
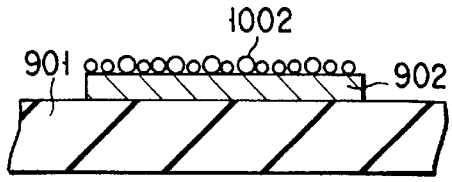
FIGS. 10A to 10C are cross-sectional views showing steps of a method of manufacturing a field emission cold-cathode device according to a modification of the fourth embodiment of the present invention.
Figure 10B:
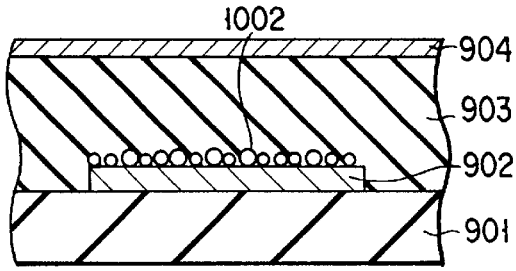
Figure 10C:
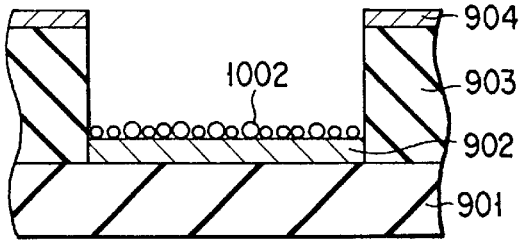

FIGS. 10A to 10C are cross-sectional views showing steps of a method of manufacturing a field emission cold-cathode device according to a modification of the fourth embodiment of the present invention. This modification relates to a flat-type emitter.

First, a cathode electrode 902 is formed on a glass substrate 901. Then, granular bodies or linear bodies preferably having a diameter of 50 nm or less are applied on the substrate including the cathode electrode 902, by means of printing, painting, plating, or the like. Then, those of the granular bodies or linear bodies positioned only on the cathode electrode 902 are left and adhered thereto by means of patterning or the like to form a flat-type emitter 1002 (FIG. 10A).

Subsequently, an insulating layer 903 and a conductive material layer (gate electrode) 904 are sequentially stacked all over the glass substrate 901 (FIG. 8E). Then, the insulating layer 903 and the conductive material layer 904 are partly removed to form an opening, in which an emitter 1002 is exposed, by a method using exposure, patterning, and etching. As a result, the flat-type emitter 1002 formed of granular bodies or linear bodies is obtained along with the electrode 904 around it (FIG. 10C).

The flat-type emitter shown in FIGS. 10A to 10C is arranged on the cathode electrode which works as a conductive support layer. The cathode electrode also works as an adhesion layer for fixing the granular bodies or linear bodies, and thus the bodies can be easily fixed. Further, this conductive support layer allows a voltage to be uniformly applied, thereby preventing an abnormal discharge.

The emitter 1002 may be formed of a low-work-function material having a work function of 4.0 eV or less, and a NEA material having a negative electron affinity, in which one of the low-work-function material and the NEA material forms granular bodies or linear bodies having a very small diameter described before, and the other forms a covering layer filling the gaps among them. Further, the emitter 1002 may be formed of a low-work-function material and a NEA material both forming granular bodies or linear bodies mixed with each other, and may further include another conductive material filling the gaps among them, if necessary. Furthermore, the emitter 1002 may be formed of granular bodies or linear bodies made only of another conductive material, which is listed with reference to the electron-emission layer 503.

[Fifth Embodiment]

Figure 11:
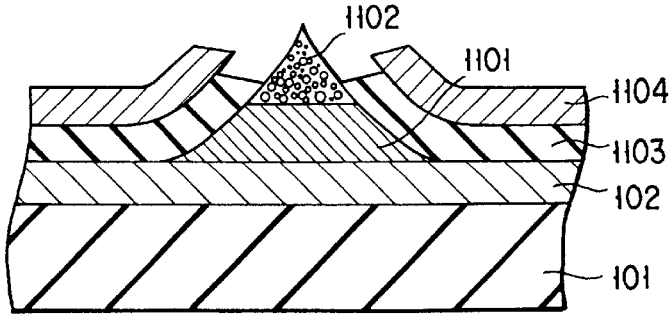
FIG. 11 is a cross-sectional view showing a field emission cold-cathode device according to a fifth embodiment of the present invention.

FIG. 11 is a cross-sectional view showing a field emission cold-cathode device according to a fifth embodiment of the present invention.

A cathode electrode 102 is arranged on a glass substrate 101. On the cathode electrode 102, there is a convex emitter formed of a ballast resistor layer 1101 made of a resistive material having a resistivity of from $10^{-3}$ to $10^{9}$ Ωcm and an electron-emission layer 1102.

The electron-emission layer 1102 may be formed of a low-work-function material having a work function of 4.0 eV or less, and a NEA material having a negative electron affinity, in which one of the low-work-function material and the NEA material forms granular bodies or linear bodies having a very small diameter described before, and the other forms a covering layer filling the gaps among them. Further, the electron-emission layer 1102 may be formed of a low-work-function material and a NEA material both forming granular bodies or linear bodies mixed with each other, and may further include another conductive material filling the gaps among them, if necessary. Furthermore, the electron-emission layer 1102 may be formed of granular bodies or linear bodies made only of another conductive material, which is listed with reference to the electron-emission layer 503.

FIGS. 12A to 12G are cross-sectional views showing steps of a method of manufacturing the field emission cold-cathode device shown in FIG. 11.

First, a hole is formed in a metal plate, such as a metal film or a metal sheet, such that the hole penetrates the metal plate, but has a constricted portion near the center. The hole may be formed by a method utilizing an etching process of a NiFe alloy substrate, as described below.

Figure 12A:
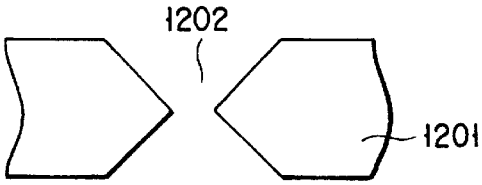
FIGS. 12A to 12G are cross-sectional views showing steps of a method of manufacturing the field emission cold-cathode device shown in FIG. 11.

Specifically, photoresist layers (not shown) are applied one on either side of the NiFe alloy substrate 1201 by means of spin-coating, printing, spray-painting, or the like. Then, the photoresist layer is patterned, and the NiFe alloy substrate 1201 is etched by a ferric chloride etching solution. The photoresist layer is removed thereafter. With these steps, a hole 1202 is formed in the NiFe alloy (Invar) substrate 1201 such that the hole 1202 having a diameter of about 5 μm and a depth of about 5 μm with a constrict portion having a diameter of 1 μm near the center (FIG. 12A).

Figure 12B:
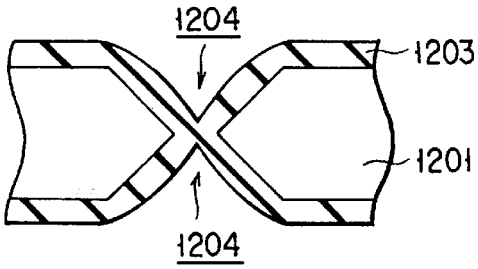

Subsequently, an NiFe oxide layer 1203 generally made of $Ni_xFe_{1-x}O_4$ is formed on a region of the NiFe alloy (Invar) substrate 1201 including the hole 1202. Consequently, the central portion of the hole 1202 is closed to form two recesses 1204 having a sharp bottom (FIG. 12B).

In this embodiment, a 0.4-μm thick NiFe oxide layer is formed as the oxide layer 1203 by a heat treatment in an oxygen atmosphere. The oxide layer 1203 may be formed by another method, such as a thermal oxidation in an air atmosphere or in a water vapor atmosphere under a high temperature and a high pressure. In place of the oxide layer 1203, an electroplating layer of Ni or the like may be used to form two recesses 1204. In this case, the electroplating layer may be oxidized to form an oxide layer. Where no gate electrode is arranged, or the oxide layer 1203 is not used as the insulating film between the gate and an emitter, a chemical oxidation may be used.

Subsequently, an electron-emission layer 1102 including granular bodies or linear bodies is formed on the oxide layer 1203 at the bottom of each recess 1204 by means of vapor deposition, sputtering, CVD, coating, dispensing, painting, dipping, a method using an ultrasonic wave, a method using vibration, or the like.

Then, a ballast resistor layer 1101 made of Si, cermet, glass, grazed ceramic, ruthenium, resin, or the like is formed on the electron-emission layer 1102 at the bottom of the recess 1204 by means of vapor deposition, sputtering, CVD, printing, dispensing, coating, dipping, a method using UV setting, a method using thermosetting, a method using pressure, or the like. The ballast resistor layer is preferably designed to have a resistive ballast effect of preventing over-current. In this case, a number of arrayed emitters should be electrically isolated from each other by means of etching or the like to enhance the resistive ballast effect. Further, the ballast resistor layer 1101 may be used as a cathode electrode. A conductive layer may be formed on the ballast resistor layer 1101, wherein a conductive layer is used also as a joint layer for coupling it to the cathode electrode or the glass substrate.

Figure 12C:
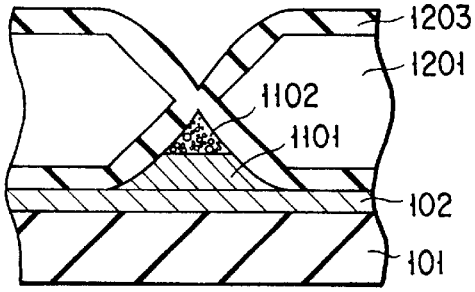

On the other hand, a support substrate, i.e., a glass substrate 101, with a cathode electrode 102 formed thereon, is prepared, and is adhered to the NiFe alloy substrate 1201, with the electron-emission layer 1102 and the ballast resistor layer 1101 interposed therebetween (FIG. 12C). In this embodiment, the backside of the glass substrate is coated with an Al layer, and electrostatic adhesion is used to perform this adhesion, though an adhesive may be used instead. Then, the Al layer on the backside of the glass substrate 101 is removed by a mixed acid solution of, e.g., $HNO_3$—HF.

Figure 12D:
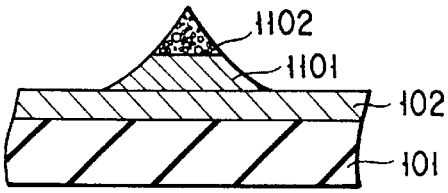

Subsequently, the NiFe alloy (Invar) substrate 1201 and the oxide layer 1203 are removed by means of etching, using, e.g., hydrochloric acid, so that the emitter formed of the electron-emission layer 1102 and the ballast resistor layer 1101 is exposed (FIG. 12D). Namely, the emitter is made of materials which fill the recess 1204 of the NiFe alloy (Invar) substrate 1201. By using these steps, a field emission cold-cathode device, which has a sharp emitter and a high mass-productivity, is provided.

The resultant structure thus obtained may be applied as it is to various kinds of electron devices. In order to draw more electrons from the tip layer, however, the resultant structure may be further provided with a gate electrode by fabrication steps shown in FIGS. 12E to 12G.

Figure 12E:
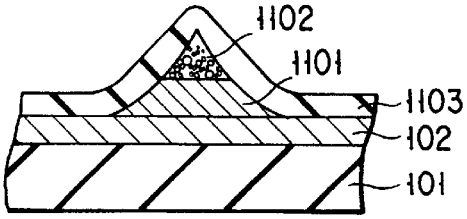
Figure 12F:
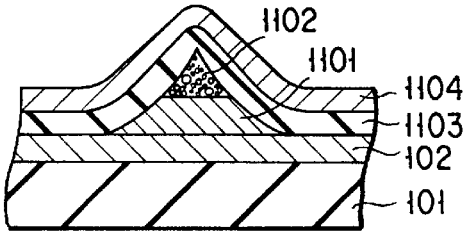

First, an insulating layer 1103 made of $SiO_2$, SiN, or the like is formed as an insulating layer between the gate and emitter by means of CVD, sputtering, electron beam vapor deposition, printing, or the like (FIG. 12E). Then, a conductive material layer (gate electrode) 1104 made of Ni, Cr, W, or the like is formed on the insulating layer 1103 by means of electroless plating, electroplating, printing, sputtering, vapor deposition, or the like (FIG. 12F).

Figure 12G:
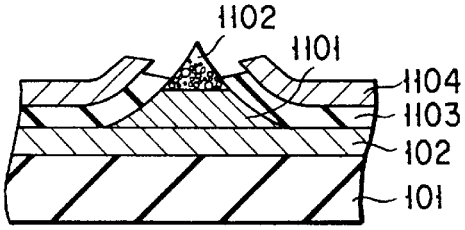

Subsequently, the conductive material layer 1104 at the tip of the convex shape is selectively etched by means of CMP, CDE, RIE, wet etching, or the like to expose the electron-emission layer 1102 (FIG. 12G).

Figure 13:
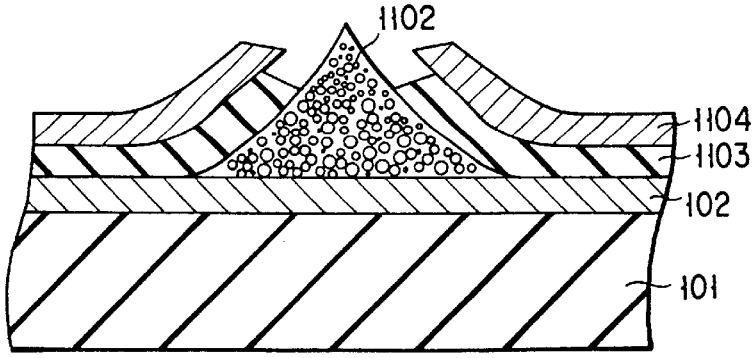
FIG. 13 is a cross-sectional view showing a field emission cold-cathode device according to a modification of the fifth embodiment of the present invention.

Although the granular bodies or linear bodies are arranged only at the tip of the convex portion in FIG. 12G, granular bodies or linear bodies may be distributed along with a support layer consisting of a resistive material all over a convex portion, as shown in FIG. 13. In this case, if the resistivity of the support layer is too high, a resistive ballast effect for the entirety of the convex portion can be adjusted by the material forming the granular bodies or linear bodies.

[Sixth Embodiment]

FIGS. 14 to 17 are cross-sectional views each showing a field emission cold-cathode device according to a sixth embodiment of the present invention.

Figure 14:
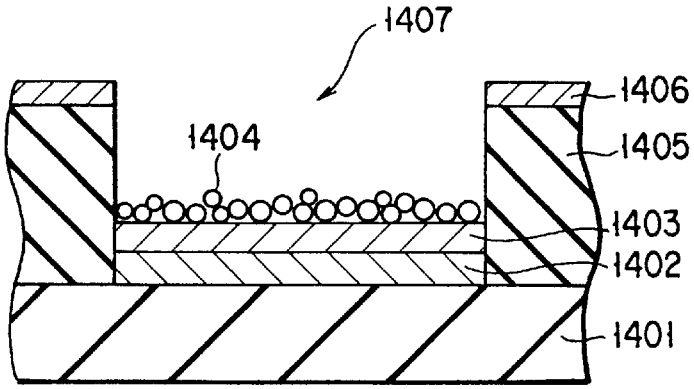
FIG. 14 is a cross-sectional view showing a field emission cold-cathode device according to a sixth embodiment of the present invention.

In the field emission cold-cathode device shown in FIG. 14, an opening 1407 is formed in an insulating layer 1405 and a gate electrode 1406 is arranged on a glass substrate 1401. A cathode electrode 1402, a ballast resistor layer 1403 made of a resistive material, and an electron-emission layer 1404 are sequentially stacked on the glass substrate 1401 in the opening 1407.

The electron-emission layer 1404 may be formed of a low-work-function material having a work function of 4.0 eV or less, and a NEA material having a negative electron affinity, in which one of the low-work-function material and the NEA material forms granular bodies or linear bodies having a very small diameter described before, and the other forms a covering layer filling the gaps among them. Further, the electron-emission layer 1404 may be formed of a low-work-function material and a NEA material both forming granular bodies or linear bodies mixed with each other, and may further include another conductive material filling the gaps among them, if necessary. Furthermore, the electron-emission layer 1404 may be formed of granular bodies or linear bodies made only of another conductive material, which is listed with reference to the electron-emission layer 503.

In this embodiment, the cathode electrode 1402, the ballast resistor layer 1403 made of a resistive material, the insulating layer 1405, the gate electrode 1406, and the electron-emission layer 1404 can be easily formed with a large surface area and at a low cost by means of printing, plating, jet-printing, or the like. Accordingly, this structure has a high mass-productivity.

Where the glass substrate 1401 has a certain unevenness, an electric field is concentrated on the portions of the electron-emission layer 1404 which are positioned on the projections of the glass substrate 1401, thereby allowing electrons to be easily emitted. Where the surface roughness of the unevenness is less than 20 nm, the concentration of the electric field is not so changed to improve the field emission characteristics, and where the surface roughness is 20 nm or more, the concentration of the electric field is enhanced to improve the field emission characteristics.

This field emission cold-cathode device may be formed by any one of the following methods.

In a first method, an insulating layer 1405 and a gate electrode 1406 are stacked on a glass substrate 1401, and an opening 1407 is formed therein by a method using exposure, patterning, and etching. Then, a cathode electrode 1402, a ballast resistor layer 1403, and an electron-emission layer 1404 are formed on the glass substrate 1401 in the opening 1407.

In a second method, a cathode electrode 1402 and/or a ballast resistor layer 1403 are formed on a glass substrate 1401. Then, an insulating layer 1405 and a gate electrode 1406 are formed, and an opening 1407 is formed therein by a method using exposure, patterning, and etching. Then, an electron-emission layer 1404 is formed.

In a third method, a cathode electrode 1402, a ballast resistor layer 1403, and an electron-emission layer 1404 are formed on a glass substrate 1401. Then, an insulating layer 1405 and a gate electrode 1406 are formed, and an opening 1407 is formed therein by a method using exposure, patterning, and etching. Then, an electron-emission layer 1404 is formed. In this case, an emitter protection layer may be formed before formation of the insulating layer, such that the emitter protection layer is removed and the electron-emission layer 1404 is activated by RIE, etching, or the like after the opening is formed.

If the electron-emission layer 1404 can be formed to have a convex shape by means of jet-printing or the like, as shown in FIG. 12D, the following modification is possible. Specifically, a cathode electrode 1402 and a ballast resistor layer 1403, and further an inter-line insulating layer and an inter-layer insulating layer, if necessary, are formed on a glass substrate 1401. Then, in accordance with the steps shown in FIGS. 12E to 12G, a gate electrode is fabricated by a so-called self-alignment process, utilizing a fact that the tip of the convex shape is first exposed by etching without using a mask. With this method, convex electron-emission layers with a gate can be formed in an opening 1407.

Figure 15:
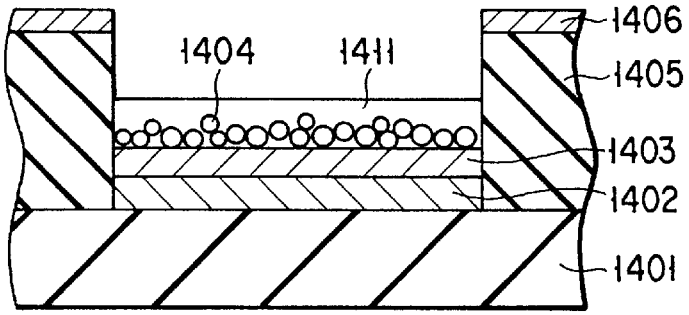
FIGS. 15 to 17 are cross-sectional views each showing a field emission cold-cathode device according to a modification of the sixth embodiment of the present invention.

The field emission cold-cathode device shown in FIG. 15 has a structure almost the same as that shown in FIG. 14, but unlike the device shown in FIG. 14, an electron-emission layer 1404 including granular bodies or linear bodies is covered with a covering layer 1411 made of an insulating or resistive material, such as a dielectric glass, resin, or the like.

The covering layer 1411 prevents the electron-emission layer from being degraded, deformed, or destroyed due to sputtering on the electron-emission layer by residual gas ions. The covering layer 1411 preferably has a thickness of 50 nm or less, because a thickness more than 50 nm makes it hard to allow electron tunneling or to generate an electron transmitting path therein. Instead of arranging the covering layer on the electron-emission layer, the materials of the electron-emission layer and the covering layer may be mixedly arranged.

Figure 16:
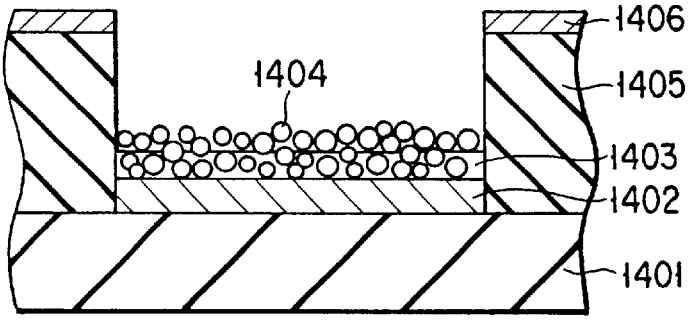

The field emission cold-cathode device shown in FIG. 16 has a structure almost the same as that shown in FIG. 14, but unlike the device shown in FIG. 14, granular bodies or linear bodies constituting an electron-emission layer 1404 are partly embedded in a ballast resistor layer 1403. In this case, the electron-emission layer 1404 can strongly stick to the ballast resistor layer 1403, and the granular bodies or linear bodies are prevented from being pealed or deformed due to stress caused by a large electric field, so that no emitter damages or electron beam deformations are cased.

Figure 17:
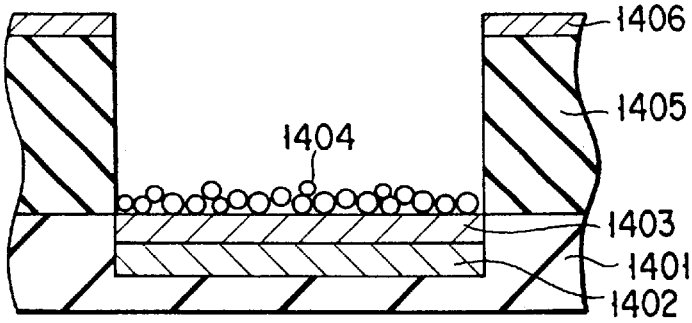

The field emission cold-cathode device shown in FIG. 17 has a structure in which a groove is formed in the glass substrate 1401, and a cathode electrode 1402 and a ballast resistor layer 1403, which are thick, are formed in the groove by means of plating, printing, or the like. With this device, the wiring resistance is reduced, so that, where the device is applied to a large image display device, a signal delay problem is solved. Further, there is another advantage in that the glass substrate itself can be used as an insulating layer between two cathode electrodes 1402.

FIGS. 18A to 18D are cross-sectional views showing steps of a method of manufacturing the field emission cold-cathode device shown in FIG. 17.

Figure 18A:
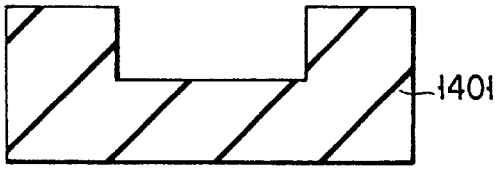
FIGS. 18A to 18D are cross-sectional views showing steps of a method of manufacturing the field emission cold-cathode device shown in FIG. 17.
Figure 18B:
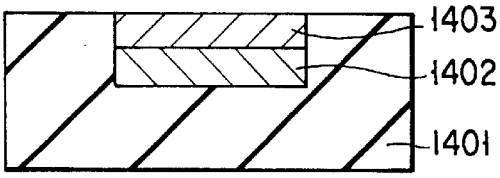

First, a groove or recess is formed in a glass substrate 1401 by a method using exposure, patterning, and etching (FIG. 18A). In this case, a photosensitive glass may be used to omit a photoresist coating step. Then, a cathode electrode 1402 and a ballast resistor layer 1403 are formed on the glass substrate 1401 in the groove (FIG. 18B).

Figure 18C:
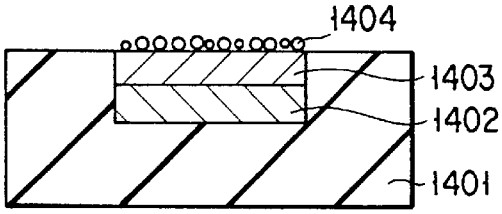
Figure 18D:
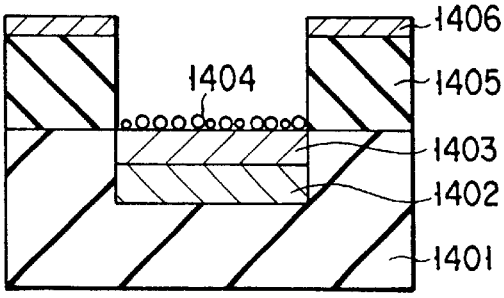

Subsequently, an electron-emission layer 1404 is formed by means of printing, jet-printing, stamping, dispensing, or the like, using granular bodies or linear bodies prepared as a paste or ink (FIG. 18C). Then, an insulating layer 1405 and a gate electrode 1406 are stacked all over, and patterned to form an opening therein, thereby completing an emitter with a gate (FIG. 18D).

FIGS. 19A to 19D are cross-sectional views showing steps of a method of manufacturing a modification of the field emission cold-cathode device shown in FIG. 17.

Figure 19A:
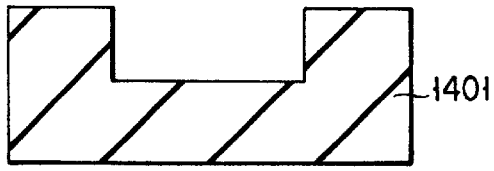
FIGS. 19A to 19D are cross-sectional views showing steps of a method of manufacturing a modification of the field emission cold-cathode device shown in FIG. 17.
Figure 19B:
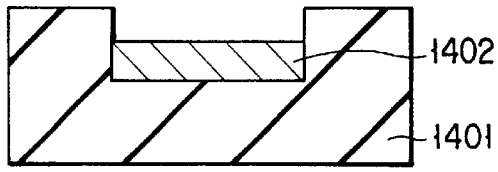
Figure 19C:
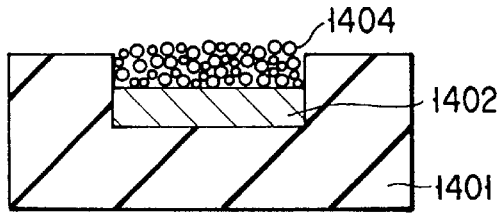

In this modification, first, a cathode electrode 1402 is arranged in a groove formed in a glass substrate 1401 (FIGS. 19A and 19B). Then, an electron-emission layer 1404 is formed from a mixture of granular bodies or linear bodies and a resistive body on the cathode electrode 1402 by means of printing, painting, or the like (FIG. 19C).

Figure 19D:
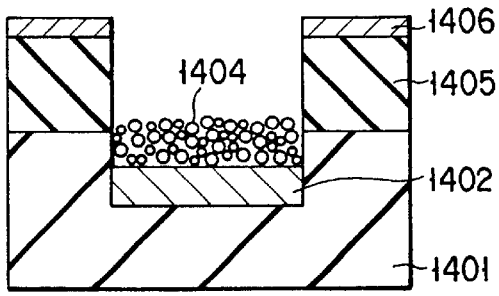

Subsequently, a ballast resistor layer is formed to fill the gaps among the granular bodies or linear bodies by means of vapor deposition, dispensing, dipping, or the like. With this step, the granular bodies or linear bodies are strongly adhered to the cathode electrode 1402. Further, the granular bodies or linear bodies are covered with the ballast resistor layer to protect them from sputtering by residual gas ions. Then, an insulating layer 1405 and a gate electrode 1406 are formed, thereby completing an emitter with a gate (FIG. 19D).

FIGS. 20A to 20D are cross-sectional views showing steps of a method of manufacturing another modification of the field emission cold-cathode device shown in FIG. 17.

Figure 20A:
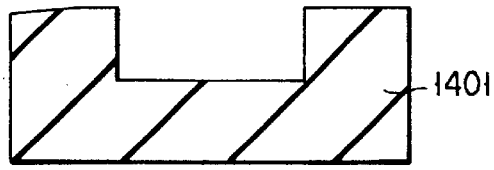
FIGS. 20A to 20D are cross-sectional views showing steps of a method of manufacturing another modification of the field emission cold-cathode device shown in FIG. 17.
Figure 20B:
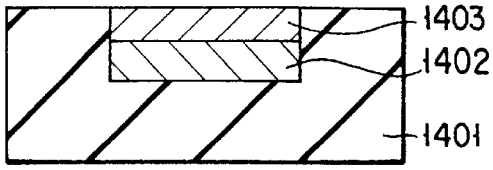
Figure 20C:
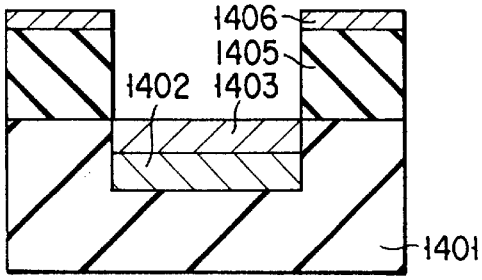

In this modification, first, a cathode electrode 1402 and a ballast resistor layer 1403 are arranged in a groove formed in a glass substrate 1401 (FIGS. 20A and 20B). Then, an insulating layer 1405 and a gate electrode 1406 are stacked all over, and patterned to form an opening therein (FIG. 20C).

Figure 20D:
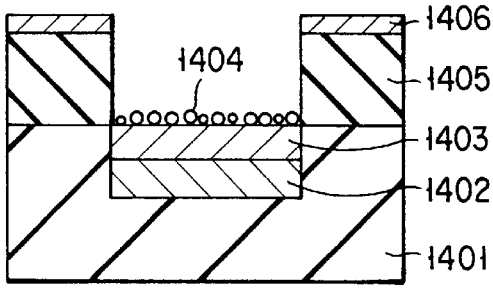

Subsequently, an electron-emission layer 1404 is formed from granular bodies or linear bodies by means of jet-printing, dispensing, vapor phase synthesis, vapor deposition, or the like, thereby completing an emitter with a gate (FIG. 20D).

Figure 21:
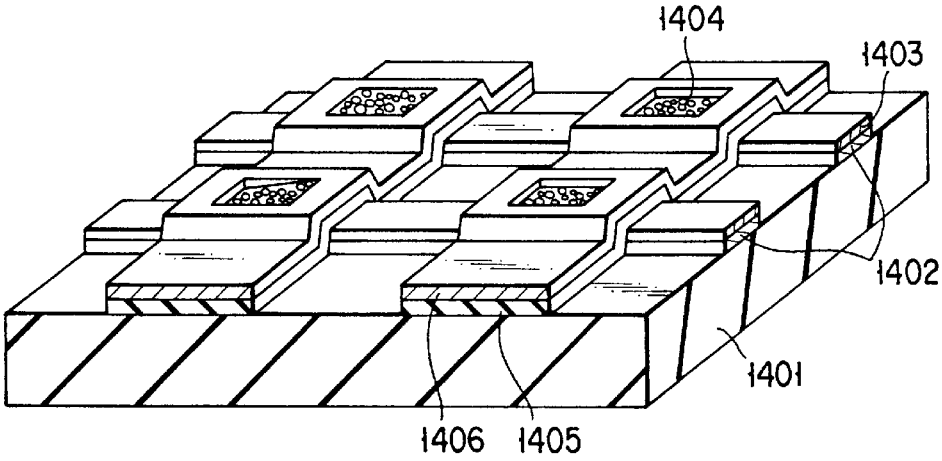
FIG. 21 is a perspective view showing a matrix-emitter array employing the field emission cold-cathode device shown in FIG. 14.

FIG. 21 is a perspective view showing a matrix-emitter array employing the field emission cold-cathode device shown in FIG. 14.

On a glass substrate 1401, cathode electrodes 1402 and ballast resistor layers 1403 extend in a first direction, and insulating layers 1405 and gate electrodes 1406 extend in a second direction perpendicular to the first direction. An opening is formed at each of the intersections of the electrodes 1402 and 1406 to expose an electron-emission layer 1404. In other words, a plurality of electron-emission layers 1404 are arranged at intersections of the electrodes 1402 and 1406 to be in a matrix format in the plan view. Each of the electron-emission layers 1404 is formed of a low-work-function material having a work function of 4.0 eV or less, and a NEA material having a negative electron affinity, and includes granular bodies or linear bodies. An electron device having the above-described structure can be driven with a low voltage and a low signal delay and can be applied to a large image display device or the like.

[Seventh Embodiment]

Figure 22:
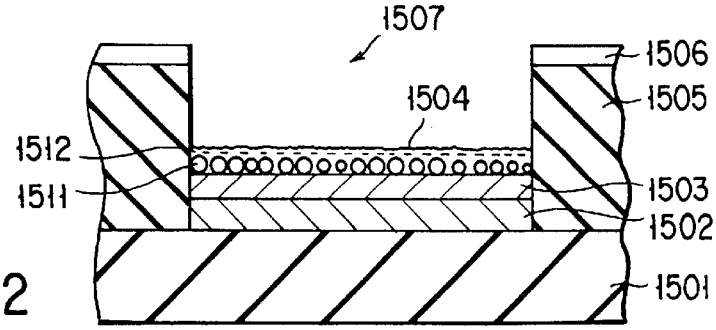
FIG. 22 is a cross-sectional view showing a field emission cold-cathode device according to a seventh embodiment of the present invention.

FIG. 22 is a cross-sectional view showing a field emission cold-cathode device according to a seventh embodiment of the present invention.

An opening 1507 is formed in an insulating layer 1505 and a gate electrode 1506 arranged on a glass substrate 1501. A cathode electrode 1502, a ballast resistor layer 1503 made of a resistive material, and an electron-emission layer 1504 are sequentially stacked on the glass substrate 1501 in the opening 1507.

The electron-emission layer 1504 is constituted of a lower layer 1511 formed of granular bodies or linear bodies each having a diameter of 1 to 100 nm, and a thin upper layer 1512 having a thickness of from 1 to 100 nm. This electron-emission layer 1504 used for a flat-type emitter can be fabricated by means of plating, vapor deposition, sputtering, CVD, or the like to apply the upper layer 1512 onto the granular bodies or linear bodies constituting the lower layer 1511.

One of the lower layer 1511 and the upper layer 1512 is made of a low-work-function material having a work function of 4.0 eV or less, such as $LaB_6$, TiN, TiC, carbon nanotube, or cermet, and the other is made of a NEA material having a negative electron affinity, such as AlN, GaN, or diamond. Preferably, the lower layer 1511 formed of granular bodies or linear bodies is made of a low-work-function material having a work function of 4.0 eV or less, and the upper layer 1512 covering the lower layer 1511 is made of a NEA material having a negative electron affinity.

In the structure shown in FIG. 22, since the upper layer 1512 is as thin as from 1 to 100 nm, an unevenness is formed on the surface of the upper layer 1512 due to the shape of the granular bodies or linear bodies constituting the lower layer 1511. As a result, an electric field is concentrated on projections of the unevenness, thereby allowing electrons to be easily emitted.

[Common Matters to the First to Seventh Embodiment]

Figure 23A:
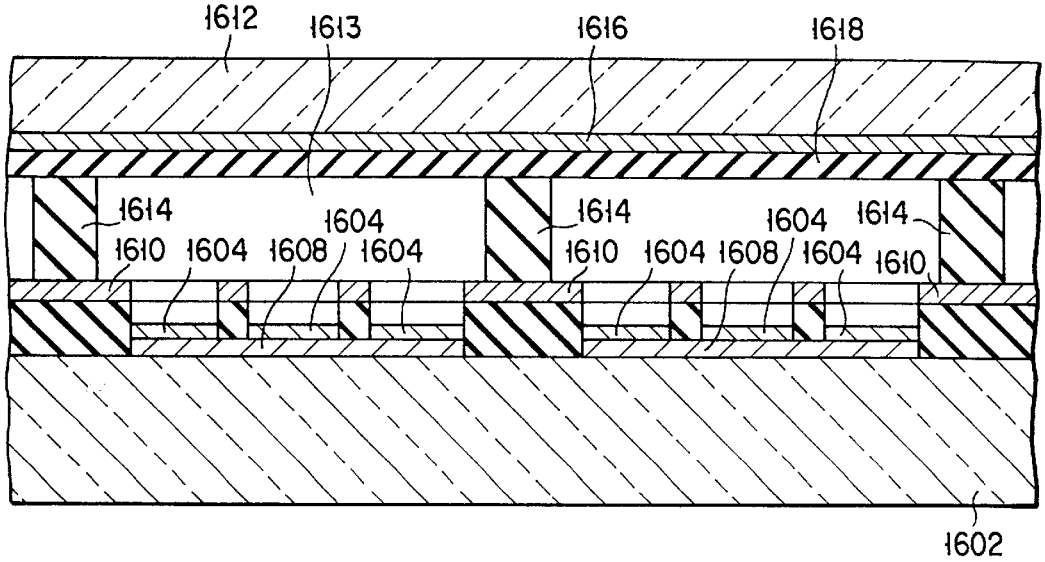
FIGS. 23A and 23B are cross-sectional views each showing a flat-type image display device as an example of a vacuum micro device according to an embodiment of the present invention.

FIG. 23A is a cross-sectional view showing a flat-type image display device as an example of a vacuum micro device according to an embodiment of the present invention. Although emitters 1604 are shown as a flat-type in FIG. 23A for the sake of drawing simplification, each of the emitters can have any shape, such as a pyramid, column-like, or flat shape.

As shown in FIG. 23A, a plurality of gate lines constituting gate electrodes 1610 are arranged in a direction parallel to the drawing surface, and a plurality of cathode lines constituting a cathode interconnecting layer 1608 are arranged in a direction perpendicular to the drawing surface. Emitter groups each including a plurality of emitters 1604 are arranged on the cathode lines, corresponding one-to-one with pixels.

A glass opposing substrate 1612 is so disposed as to oppose a glass support substrate 1602, and vacuum discharge spaces 1613 are formed between the two substrates 1602 and 1612. The gap between the two substrates 1602 and 1612 is maintained by peripheral frames and spacers 1614. A transparent common electrode or anode electrode 1616 and a phosphor layer 1618 are formed on the surface of the opposing substrate 1612 which opposes the support substrate 1602.

In this flat-type image display device, pixels can be selectively turned on or off by setting an arbitrary voltage between the gate electrode 1610 and the emitter 1604 at each pixel via the gate line and the cathode line. That is, a pixel can be selected by so-called matrix driving, e.g., by selecting a gate line in a line sequential manner and applying a predetermined potential to the line and, in synchronism with this potential application, applying a predetermined potential as a selection signal to a cathode line.

When a certain gate line and a certain cathode line are selected and respective predetermined potentials are applied to these lines, only an emitter group at the intersection between the gate line and the cathode line operates. Electrons emitted from the emitter group are attracted by a voltage applied to the anode electrode 1616 and reach the phosphor layer 1618 in a position corresponding to the selected emitter group, thereby making the phosphor layer 1618 emit light.

Figure 23B:
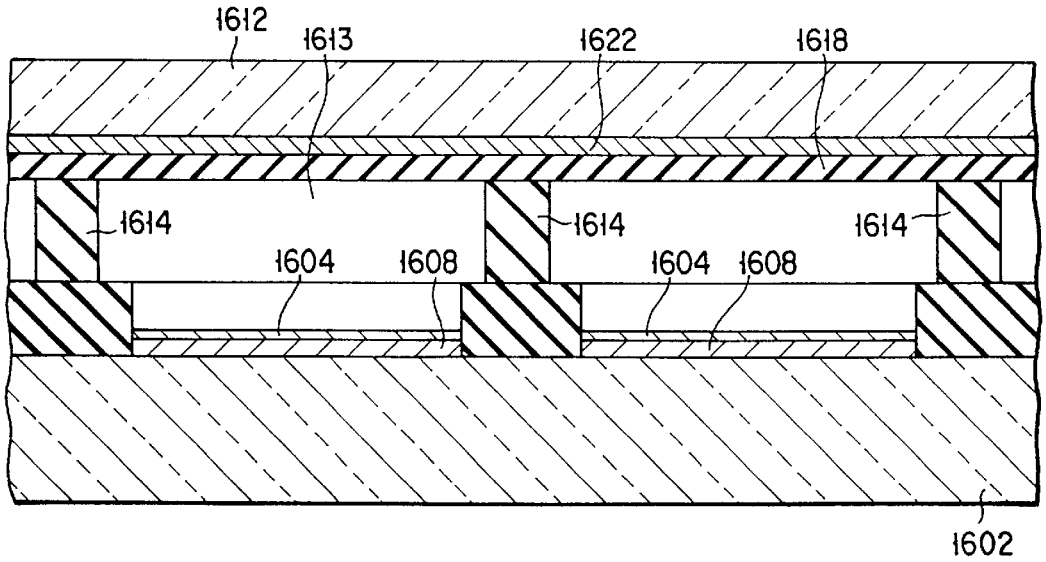

Note that as shown in FIG. 23B, a display device can be constructed without using the gate electrodes 1610.

In this flat-type image display device, a plurality of anode lines, instead of cathode lines, constituting transparent anode electrodes 1622 on the opposing substrate 1612 are arranged in the direction parallel to the drawing surface. Accordingly, pixels can be selectively turned on or off by setting an arbitrary voltage between the anode electrode 1622 and the emitter 1604 at each pixel via the anode line and the cathode line. When a certain anode line and a certain cathode line are selected and respective predetermined potentials are applied to these lines, only an emitter group at the intersection between the anode line and the cathode line operates.

In the display devices shown in FIGS. 23A and 23B, each of the emitters 1604 has an electron-emission layer, such as the electron-emission layer 1504 shown in FIG. 22, at the surface. The electron-emission layer includes a first part consisting essentially of a low-work-function material, and a second part arranged in contact with the first part and consisting essentially of a NEA material. Further, at least one of the first and second parts includes granular bodies or linear bodies each having a diameter of 100 nm or less, and preferably 30 nm or less. With the combination of these features in materials and shapes, electrons are easily emitted from the emitters by field emission, so that the display device can be driven with a low voltage, and have field emission characteristics improved to be uniform and stable.

A vacuum micro device utilizing a field emission cold-cathode device according to the present invention is not limited to display devices, but may be applied to vacuum micro devices other than display devices, e.g., power converters such as power switching devices. Such other devices according to the present invention can also be driven with a low voltage, and have field emission characteristics improved to be uniform and stable.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A field emission cold-cathode device comprising:

a support member; and an emitter formed on said support member to emit electrons, said emitter comprising at a surface an electron-emission layer including a first part consisting essentially of a first conductive material having a work function of 4.0 eV or less, and a second part arranged in contact with said first part and consisting essentially of a second conductive material having a negative electron affinity, one of said first and second parts comprising granular bodies or linear bodies each having a diameter of 100 nm or less.

2. The device according to claim 1, wherein said first part is formed of a lower layer, and said second part is formed of an upper layer arranged on said lower layer.

3. The device according to claim 2, wherein said upper layer comprises said granular bodies or linear bodies.

4. The device according to claim 2, wherein said lower layer comprises said granular bodies or linear bodies, and said upper layer comprises a thin layer having thickness of from 1 to 100 nm and arranged to cover said granular bodies or linear bodies.

5. The device according to claim 1, wherein each of said first and second parts comprises granular bodies or linear bodies each having a diameter of 100 nm or less.

6. The device according to claim 1, wherein said second part comprises a lower layer including said granular bodies or linear bodies, and said first part comprises a thin upper layer having a thickness of from 1 to 100 nm and arranged to cover said granular bodies or linear bodies.

7. The device according to claim 1, wherein said emitter further comprises a ballast resistor layer having a resistivity of from $10^{-3}$ to $10^{9}$ Ωcm, and said electron-emission layer is arranged on said ballast resistor layer.

8. The device according to claim 1, further comprising a thin dielectric layer having a thickness of 50 nm or less and covering said electron-emission layer.

9. The device according to claim 1, wherein said second conductive material is a material selected from the group consisting of AlN, GaN, and diamond.

10. The device according to claim 1, wherein said first conductive material is a material selected from the group consisting of $LaB_6$, TiN, TiC, carbon nanotube, and cermet.

11. A vacuum micro device comprising:

a support member;

an emitter formed on said support member to emit electrons, said emitter comprising at a surface an electron-emission layer including a first part consisting essentially of a first conductive material having a work function of 4.0 eV or less, and a second part arranged in contact with said first part and consisting essentially of a second conductive material having a negative electron affinity, one of said first and second parts comprising granular bodies or linear bodies each having a diameter of 100 nm or less;

a surrounding member for forming, together with said support member, a vacuum discharge space surrounding said emitter; and an extracting electrode arranged to be spaced apart from said emitter, said emitter emitting electrons due to a potential difference between said emitter and said extracting electrode.

12. The device according to claim 11, wherein said first part is formed of a lower layer, and said second part is formed of an upper layer arranged on said lower layer.

13. The device according to claim 11, wherein said extracting electrode comprises a gate electrode supported by said support member.

14. The device according to claim 11, wherein an anode electrode is arranged on said surrounding member to face said emitter.

15. The device according to claim 11, wherein said extracting electrode comprises an anode electrode arranged on said surrounding member to face said emitter.

16. An image display device comprising:

a support member;

an emitter formed on said support member to emit electrons, said emitter comprising at a surface an electron-emission layer including a first part consisting essentially of a first conductive material having a work function of 4.0 eV or less, and a second part arranged in contact with said first part and consisting essentially of a second conductive material having a negative electron affinity, one of said first and second parts comprising granular bodies or linear bodies each having a diameter of 100 nm or less;

a surrounding member for forming, together with said support member, a vacuum discharge space surrounding said emitter;

an extracting electrode arranged to be spaced apart from said emitter, said emitter emitting electrons due to a potential difference between said emitter and said extracting electrode; and a display portion for displaying an image in accordance with excitation by electrons emitted from said emitter, said display portion being turned on and off under a control of the potential difference between said emitter and said extracting electrode, on which emission of electrons from said emitter depends.

17. The device according to claim 16, wherein said first part is formed of a lower layer, and said second part is formed of an upper layer arranged on said lower layer.

18. The device according to claim 17, wherein said vacuum discharge space contains a substance for emitting light due to excitation by electrons emitted from said emitter.

19. The device according to claim 18, wherein said substance comprises a phosphor.

20. The device according to claim 18, wherein said substance forms a layer arranged at a position facing said emitter.

* * * * *